US008648677B2

(12) United States Patent
Su et al.

(10) Patent No.: US 8,648,677 B2
(45) Date of Patent: Feb. 11, 2014

(54) KEY AND KEYBOARD USING SAME

(75) Inventors: Hong-Ti Su, Taipei Hsien (TW); Hsien-Ta Lin, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 781 days.

(21) Appl. No.: 12/886,585

(22) Filed: Sep. 21, 2010

(65) Prior Publication Data

US 2011/0227761 A1 Sep. 22, 2011

(30) Foreign Application Priority Data

Mar. 16, 2010 (CN) ..... 2010 1 0125503

(51) Int. Cl.
*H01H 9/00* (2006.01)

(52) U.S. Cl.
USPC ..... 335/205; 345/168

(58) Field of Classification Search
USPC ..... 335/205–207; 345/168–170; 200/404
See application file for complete search history.

(56) References Cited

U.S. PATENT DOCUMENTS

| | | | | |
|---|---|---|---|---|
| 4,054,944 | A * | 10/1977 | Lau | 335/207 |
| 5,381,272 | A * | 1/1995 | Kato et al. | 359/823 |
| 5,977,888 | A * | 11/1999 | Fujita et al. | 341/34 |
| 6,336,727 | B1 * | 1/2002 | Kim | 362/23 |
| 8,232,494 | B2 * | 7/2012 | Purcocks | 200/521 |
| 8,471,658 | B2 * | 6/2013 | Fullerton et al. | 335/205 |

* cited by examiner

*Primary Examiner* — Bernard Rojas
(74) *Attorney, Agent, or Firm* — Altis Law Group, Inc.

(57) ABSTRACT

A keyboard is provided. The keyboard includes a housing and keys. The housing includes frames defining a first through hole to receive the keys and defines a receiving space to receive the frames. The housing includes switches. The receiving space defines slots to receive first magnetic members. Each key is arranged over the switch. Each key includes a base, second magnetic members, a convex lens, and a plate. The base defines a second through hole to receive the convex lens and plate. The plate is arranged below the convex lens. A label is sealed on a top of the plate. The convex lens is rotated, the distance between the convex lens and the plate changes. The size of the image of the label thus changes. The key is depressed to press the switch, the switch is actuated, when the key is released, the key is separate from the switch.

15 Claims, 5 Drawing Sheets

KEY AND KEYBOARD USING SAME

BACKGROUND

1. Technical Field

The present disclosure relates to keyboards and, particularly, to a key and a keyboard using the same.

2. Description of Related Art

Keypads of portable electronic devices, such as mobile phones, are usually relatively smaller, and labels sealed on keys of the keypads are correspondingly smaller. When a user uses such a keypad over a long period of time, he or she may suffer from visual stress.

BRIEF DESCRIPTION OF THE DRAWINGS

The components of the drawings are not necessarily drawn to scale, the emphasis instead being placed upon clearly illustrating the principles of a key and a keyboard using the same. Moreover, in the drawings, like reference numerals designate corresponding parts throughout several views.

DETAILED DESCRIPTION

Figure 1:
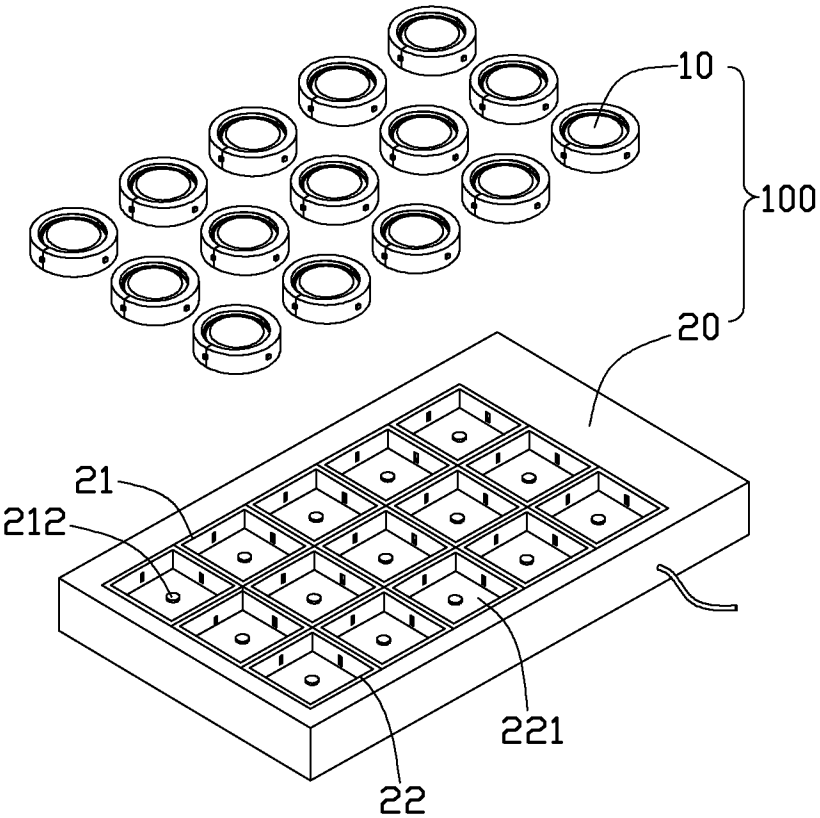
FIG. 1 is an exploded, perspective view of a keyboard in accordance with an exemplary embodiment.
Figure 2:
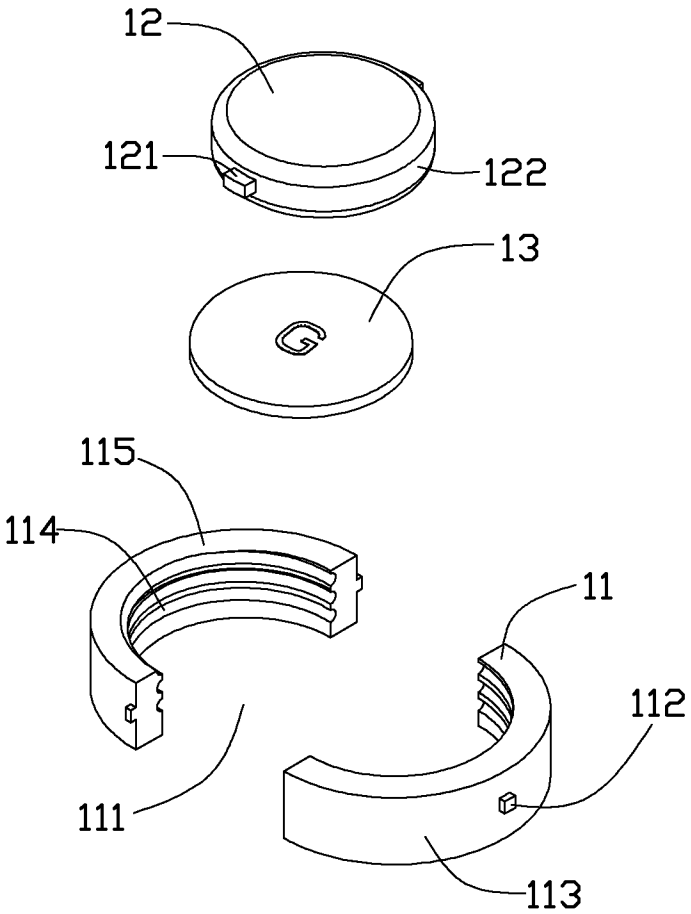
FIG. 2 is an exploded, perspective view of a key of the keyboard of FIG. 1.
Figure 3:
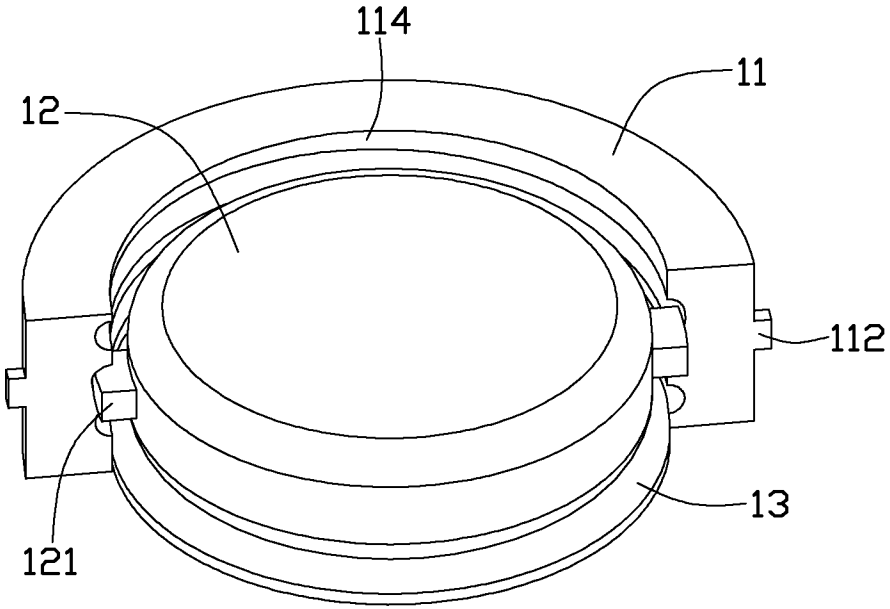
FIG. 3 is a cut-away view of the key of FIG. 2.

Referring to FIGS. 1-3, a keyboard 100 in accordance with an exemplary embodiment is shown. The keyboard 100 includes a housing 20 and a number of keys 10 received in the housing 20.

Each key 10 includes a base 11, a convex lens 12, and a plate 13. The base 11 defines a through hole 111 to receive the convex lens 12 and the plate 13. The base 11 is hollow cylinder shaped. A number of magnetic members 112 are mounted in the base 11 and partially extend from a peripheral outer surface 113 of the base 11. In the embodiment, there are four magnetic members 112, and each magnetic member 112 is a permanent magnet. A helix slot 114 is formed in an inner surface 115 of the base 11.

At least two protrusions 121 protrude from a sidewall 122 of the convex lens 12 and are spaced apart from each other. The protrusions 121 can be received in the helix slot 114 to secure the convex lens 12 to the base 11. The convex lens 12 can be rotated by an external force to move along the axis of the through hole 111 through the engagement of the protrusions 121 and the helix slot 114.

The plate 13 is securely received in the through hole 111 and arranged below the convex lens 12. The plate 13 is made of an opaque material. A label is affixed on the top of the plate 13. When the convex lens 12 is rotated by an external force to move along an axis of the through hole 111 through the engagement of the at least two protrusions 121 and the helix slot 114, the distance between the convex lens 12 and the plate 13 changes, thus the size of the image of the label changes when a user views through the convex lens 12.

Figure 4:
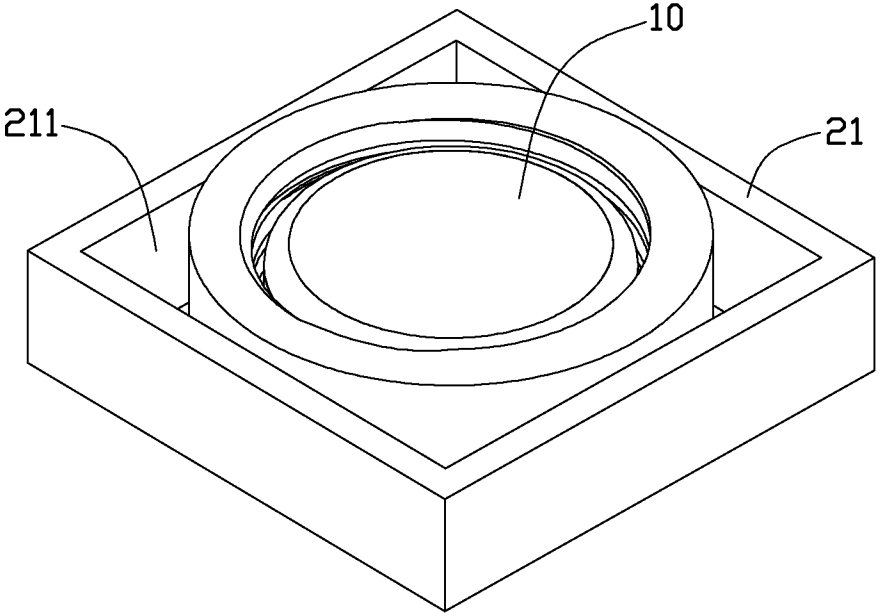
FIG. 4 is a partial, isometric view of the keyboard of FIG. 1, showing a key mounted in a frame.
Figure 5:
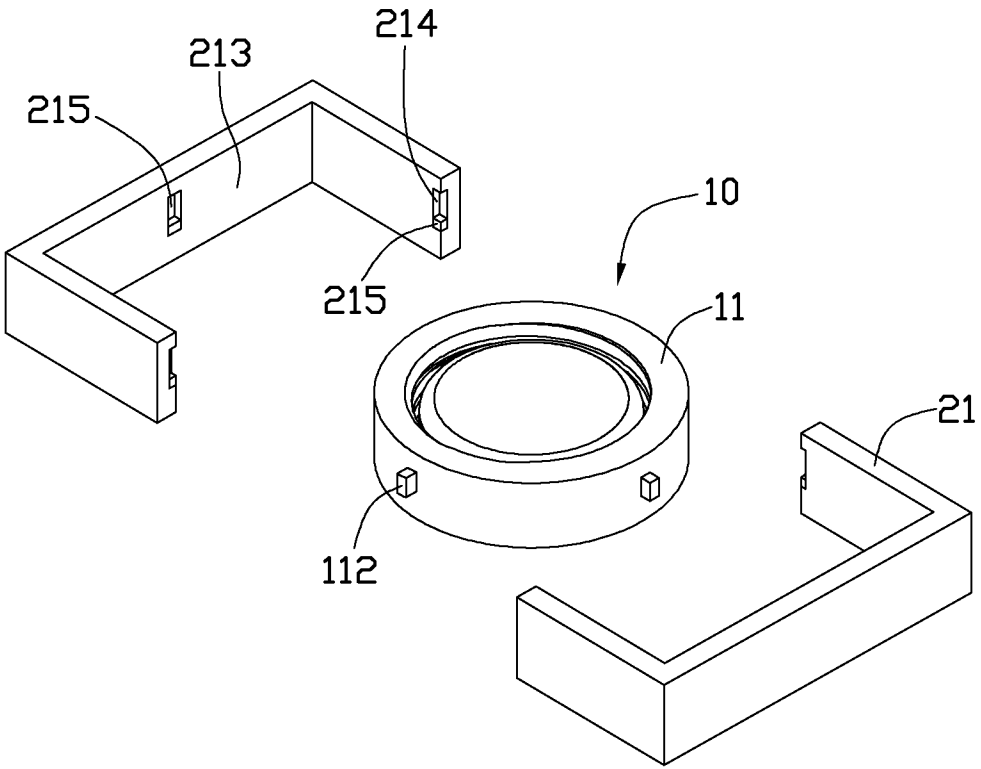
FIG. 5 is a partially exploded, perspective view of FIG. 4.

The housing 20 includes a number of frames 21 and a receiving space 22. The frames 21 are received in the receiving space 22. Each frame 21 defines a through hole 211 (see FIG. 4) to receive one key 10. A number of switches 212 are arranged on the bottom 221 of the receiving space 22, and each key 10 is arranged over one switch 212. When one key 10 is depressed to contact the switch 212 below the key 10, the switch 212 is actuated. Referring to FIGS. 4-5, an inner sidewall 213 of the frame 21 defines a number of slots 214. The number of the slots 214 is equal to that of the magnetic members 112. Each slot 214 receives a magnetic member 215. In the embodiment, each magnetic member 215 is a magnet. The height of each slot 214 is higher than the sum of the height of the magnetic member 112 and the height of the magnetic member 215, and the width of each slot 214 is the same as that of each magnetic member 112 and each magnetic member 215.

In this embodiment, each magnetic member 215 is arranged on the bottom of one slot 214, each magnetic member 112 is arranged above one magnetic member 215, the polarities of the facing ends of the magnetic member 215 and the magnetic member 112 received in the same slot 214 are the same. Therefore, each magnetic member 215 repels the magnetic member 112 over the magnetic member 215 to cause each key 10 to be separate from each switch 212. In an alternative embodiment, each magnetic member 215 is arranged on the top of one slot 214, each magnetic member 112 is arranged below one magnetic member 215, the polarities of the facing end of the magnetic member 112 and magnetic member 215 received in the same slot 214 are different. Each magnetic member 215 attracts the magnetic member 112 over the magnetic member 215 to cause each key 10 to be separate from each switch 212.

To actuate one switch 212, the key 10 corresponding to the switch 212 is depressed to cause the magnetic members 112 of the key 10 to move downwards in the slots 214 of the frame 21 until the key 10 presses the switch 212. At this point, the switch 212 is actuated. When the key 10 is released, the magnetic members 112 are driven to move upwards in the slots 214 under the magnetic force between the magnetic members 112 and the magnetic members 215 until the key 10 is separate from the switch 212.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A key comprising:

a base defining a through hole, an inner surface of the base defining a helix slot;

a convex lens received in the through hole, at least two protrusions protruding from an outer sidewall of the convex lens, the at least two protrusions rotatably engaging the helix slot to secure the convex lens to the base; and a plate securely received in the through hole and arranged below the convex lens, a label being sealed on a top of the plate;

wherein when the convex lens is rotated by an external force to move along an axis of the through hole through the engagement of the at least two protrusions and the helix slot, the distance between the convex lens and the plate changes, and the size of the image of the label thus changes when viewing through the convex lens.

2. The key as described in claim 1, wherein the plate is made of opaque material.

3. A keyboard comprising:

a housing comprising a plurality of frames, defining a receiving space to receive the frames, and comprising a plurality of switches and a plurality of first magnetic members, each of the frames defining a first through hole, each of the switches being arranged on the bottom of the receiving space, an inner sidewall of each of the frames defining a plurality of slots, each of the slots being configured to receive one of the first magnetic members; and a plurality of keys, each of the keys being received in the first through hole of one of the frames and arranged over one of the switches, each of the keys comprising:

a base defining a second through hole, an inner surface of the base defining a helix slot;

a plurality of second magnetic members mounted in the base and partially extending from an outer surface of the base, each of the second magnetic members being received in one of the slots;

a convex lens received in the second through hole, at least two protrusions protruding from an outer sidewall of the convex lens, the at least two protrusions rotatably engaging the helix slot to secure the convex lens to the base; and a plate securely received in one second through hole of the base and arranged below the convex lens, a label being sealed on a top of the plate;

wherein the convex lens is rotated by an external force to move along an axis of the second through hole through the engagement of the at least two protrusions and the helix slot, the distance between the convex lens and the plate changes, the size of the image of the label thus changes when viewing through the convex lens; the key is depressed to cause the second magnetic member of the key moves downwards in the slots of the frame until the key presses the switch, the switch is actuated, when the key is released, the second magnetic member of the key moves upwards in the slots of the frame under the magnetic force between the first magnetic member and the second magnetic member until the key is separate from the switch.

4. The keyboard as described in claim 3, wherein the height of each of the slots of the frame is higher than the total of the height of one of the first magnetic members and the height of one of the second magnetic members, the width of each of the slots of the frame is the same as that of each of the first magnetic members and each of the second magnetic members.

5. The keyboard as described in claim 3, wherein each of the first magnetic members is above each of the second magnetic members, the polarities of the facing ends of the first magnetic member and the second magnetic member received in the same slot are the same, each of the first magnetic members repels the second magnetic member to cause each of the keys to be separate from each of the switches.

6. The keyboard as described in claim 3, wherein each of the first magnetic members is below each of the second magnetic members, the polarities of the facing ends of each of the first magnetic member and the second magnetic member received in the same slot are different, each of the first magnetic members attracts the second magnetic member to cause each of the keys to be separate from each of the switches.

7. The keyboard as described in claim 3, wherein each of the first magnetic members and each of the second magnetic members are magnet.

8. The keyboard as described in claim 3, wherein each of the plates is made of opaque material.

9. A keyboard comprising:

a housing comprising a plurality of frames, defining a receiving space to receive the frames, and comprising a plurality of switches, each of the frames defining a first through hole, each of the switches being arranged on the bottom of the receiving space; and a plurality of keys received in the first through hole of one of the frames and arranged over one of the switches, each of the keys comprising:

a base defining a second through hole, an inner surface of the base defining a helix slot;

a convex lens secured in the second through hole, at least two protrusions protruding from an outer sidewall of the convex lens, the at least two protrusions rotatably engaging the helix slot to secure the convex lens to the base; and a plate received in the second through hole and arranged below each of the convex lenses, a label being sealed on a top of each of the plates;

wherein the convex lens is rotated by an external force to move along the axis of the second through hole through the engagement of the at least two protrusions and the helix slot, the distance between the convex lens and the plate changes, the size of the image of the label thus changes when viewing through the convex lens.

10. The keyboard as described in claim 9, wherein the housing further comprises a plurality of first magnetic members, an inner sidewall of the receiving space defining a plurality of slots, each of the slots being configured to receive one of the first magnetic members, each of the keys further comprises a plurality of second magnetic members, each of the second magnetic members is mounted in the base and partially extends from an outer surface of the base, each of the second magnetic member being received in one of the slots, each of the first magnetic members engages each of the second magnetic members to cause the key to be separate from the switch.

11. The keyboard as described in claim 10, wherein the height of each of the slot of each of the frame is higher than the total of the height of each of the first magnetic member and the height of each of the second magnetic member, the width of each of the slot of each of the frame is the same as that of each of the first magnetic member and each of the second magnetic member.

12. The keyboard as described in claim 10, wherein each of the first magnetic members is above each of the second magnetic members, the polarities of the facing ends of each of the first magnetic members and the second magnetic received in the same slot are the same, each of the first magnetic members repels the second magnetic member to cause each of the keys to be separate from each of the switches.

13. The keyboard as described in claim 10, wherein each of the first magnetic members is below each of the second magnetic members, the polarities of the facing ends of each of the first magnetic member and the second magnetic member received in the same slot are different, each of the first magnetic members attracts the second magnetic member to cause each of the keys to be separate from each of the switches.

14. The keyboard as described in claim 10, wherein each of the first magnetic members and each of the second magnetic members are magnet.

15. The keyboard as described in claim 9, wherein each of the plates is made of opaque material.

* * * * *